US008256875B2

(12) United States Patent
Langevin et al.

(10) Patent No.: US 8,256,875 B2
(45) Date of Patent: Sep. 4, 2012

(54) TWO PASS PRINT MODE METHOD AND APPARATUS FOR LIMITING WIND-RELATED PRINT DEFECTS

(75) Inventors: Eric David Langevin, Lexington, KY (US); Nicholas Jon Post, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 429 days.

(21) Appl. No.: 12/491,892

(22) Filed: Jun. 25, 2009

(65) Prior Publication Data

US 2010/0328373 A1 Dec. 30, 2010

(51) Int. Cl.
*B41J 2/145* (2006.01)

(52) U.S. Cl. ..... 347/41; 347/42; 347/12

(58) Field of Classification Search ..... 347/5, 9, 347/12, 40, 41, 42
See application file for complete search history.

(56) References Cited

U.S. PATENT DOCUMENTS

| | | | | |
|---|---|---|---|---|
| 4,748,453 | A | 5/1988 | Lin et al. | |
| 5,790,150 | A | 8/1998 | Lidke et al. | |
| 6,565,191 | B1 | 5/2003 | Bolash et al. | |
| 2007/0216724 | A1 * | 9/2007 | Shibata et al. | 347/41 |

* cited by examiner

*Primary Examiner* — Lam S Nguyen

(57) ABSTRACT

A two pass print mode method and apparatus limits wind-related print defects produced during printing, utilizing a reciprocating carrier of a printer carrying a printhead having an array of columns of actuator-fired fluid-jetting nozzles along a bi-directional scanning path. Due to instructions from a controller, printing proceeds along an initial partial swath on a print medium during a first pass along the scanning path by firing actuators associated with a first plurality of segments of a given column of nozzles. Then, printing proceeds along a final partial swath on the print medium during a second pass along the scanning path by firing actuators associated with a second plurality of segments of the given column of nozzles. Each segment of nozzles of the first and second pluralities includes more than one consecutive nozzle so that gaps are created in the partial swath printing accommodating wind-related effects without causing wind-related print defects.

18 Claims, 3 Drawing Sheets

TWO PASS PRINT MODE METHOD AND APPARATUS FOR LIMITING WIND-RELATED PRINT DEFECTS

CROSS REFERENCES TO RELATED APPLICATIONS

None.

BACKGROUND

1. Field of the Invention

The present invention relates generally to an inkjet printing and, more particularly, to a two pass print mode method and apparatus for limiting wind-related print defects.

2. Description of the Related Art

Inkjet printers apply ink to a print medium, such as paper, by ejecting ink droplets from at least one printhead through a column(s) or array(s) of nozzles. The printhead is mounted on a carrier that is movable in a lateral direction across the print medium, commonly termed a unidirectional scan, and ink droplets are selectively ejected from the nozzles at corresponding ink drop placement locations. Specifically, each nozzle is associated with an actuator in the printhead that is "fired" when sufficient current passes through it, the firing causing ink within an associated ink reservoir to be ejected in droplet form from the nozzle. The printhead is moved in a series of unidirectional scans or swaths across the print medium, and between the swaths, the print medium is advanced in a longitudinal or advance direction. Since the printhead moves in a direction that is perpendicular to the advance direction of the print medium, each nozzle passes in a linear manner over the print medium. A printer controller determines which actuators will be "fired" and the proper firing sequence so that a desired image is printed on the print medium.

For a given stationary position of the print medium, printing may take place during one or more unidirectional scans of the printhead carrier. As used herein, the term "unidirectional" will refer to scanning in either, but only one, of the two possible scanning directions (left to right, or right to left). Thus, bi-directional scanning refers to two successive unidirectional scans in opposite directions. The term "swath" will refer to a plurality of printing lines traced along imaginary rasters, the imaginary rasters being spaced apart in the sheet feed or advance direction. Ink droplets are deposited along the printing lines on the print medium during a particular scan of the printhead carrier by selective actuation of the individual actuators associated with individual nozzles of the printhead to expel the ink droplets.

The quality of printed images produced by an inkjet printer depends in part on the resolution of the printheads. Thus, as the market pull for inkjet printing quality to approach that of silver halide photography continues, one method to achieving that goal is to increase the vertical and horizontal resolution of the printhead. This requires changes that will decrease both the ink droplet size and nozzle-to-nozzle spacing, therefore, necessitating an increase in firing frequency of the heater resistors to achieve the same or greater throughput while maintaining the same or greater color gamut and coverage of larger droplet size printheads. The result of these changes is optimally a decrease in graininess and an increase in sharpness.

However, aerodynamic forces and fluidic interactions from neighboring nozzles more adversely affect nozzles that are spaced closer together, and whose actuators are fired at higher frequencies, compared to nozzles producing larger droplets that are spaced farther apart and whose actuators are fired at lower frequencies. The results of these aerodynamic forces and fluidic interactions are severe print quality defects such as swath contraction, non-uniform horizontal intraswath banding, and overspray.

Print quality defects associated with aerodynamic and fluidic events, commonly referred to as wind-related defects, are particularly bad in monochromatic or black only printing. This is due to the fact that black only printing modes operate at much higher duty cycles and print speeds. Wind-related defects have also been found to be present at half frequency. Half frequency printing helps to support that the wind-related defects are primarily associated with aerodynamic events, and less contingent on a fluidic event occurring at the same time. Furthermore, wind-related defects have been found to occur at half duty cycle (specifically a typical two pass printing mode that uses a checkerboard pattern). Typical two pass printing is not only half frequency, but it is also half nozzle usage.

In summary, therefore, wind-related print defects refer to print quality defects that are caused by a combination of aerodynamic and fluidic events. The main driver is currently thought to be aerodynamic forces that effect satellite formation and placement of the satellites on print media. Wind related print defects are primarily seen in black only print modes, are present in all three of the current easy to implement print methods, and comprise some of the largest hindrances to better text quality.

Thus, there is a need for an innovation that will permit continued increase in the resolution of printheads without the accompanying aerodynamic and fluidic events that produce wind-related print defects.

SUMMARY OF THE INVENTION

The present invention meets this need by providing an innovation that, in a two pass mode of printing, segments the utilization of the nozzles in given columns thereof. The nozzle utilization is determined by the selected firing of the actuators associated with those nozzles. Specifically, only about half of the nozzles in each column are utilized at the same time during a given pass. It has been determined that severity of the wind-related print defect is dependent upon the number of consecutive nozzles in given columns of an array of nozzles that are active or utilized (that is, the number of consecutive actuators firing) at the same time. For instance, by centering the nozzles and using the entire swath height (all of the nozzles in the advance direction) a printed swath will have maximum wind-related print defects. Shortening the swath by eliminating the use of end nozzles eventually the printed swath will not show objectionable wind-related effects. Further, by sufficiently reducing the swath height, the severity and amount of wind-related effects will decrease and eventually disappear. However, due to the desire for high print speed, decreasing the swath height is not an appropriate solution.

The solution provided by this innovation is to exploit the result of smaller swath height on wind-related print defects without adopting actual swath height reduction and its attendant adverse effect on print speed. By segmenting each array or column of nozzles utilized so that only half of the nozzles in each column are utilized during a given pass, the number of consecutive nozzles jetting ink droplets in a given column is thereby limited so as to simulate the printing of a reduced swath height for that segment of the swath printed on the given pass. The result is that the gaps left in the printing by the nozzles that are dormant or not utilized, during that pass allow air flow to pass more freely through such gaps minimizing the wind-related print defect. Then, the second pass is performed (either with no advancement of paper or an advancement implemented secondarily) and the nozzles that were not utilized, or that were dormant or idle, during the first pass are now active, or utilized, during the second pass, thereby addressing the full grid within a given region in two passes.

Accordingly, in an aspect of the present invention, a two pass print mode method for limiting wind-related print defects, produced during printing by an inkjet printer including a reciprocating carrier that carries a printhead having an array of columns of actuator-fired fluid-jetting nozzles along a bi-directional scanning path, includes printing an initial partial swath on a print medium during a first pass along the scanning path by firing actuators associated with a first plurality of segments of a given column of nozzles, and printing a final partial swath on the print medium during a second pass along the scanning path by firing actuators associated with a second plurality of segments of the given column of nozzles such that each of the segments of the nozzles of the first and second pluralities thereof includes more than one consecutive nozzle so that gaps are created in the partial swath printing that accommodate wind-related effects without causing wind-related print defects on the print medium.

In another aspect of the present invention, a two pass print mode apparatus for limiting wind-related print defects includes a printer having a reciprocating carrier that carries a printhead having an array of columns of actuator-fired fluid-jetting nozzles along a bi-directional scanning path, and a controller communicatively coupled to the printhead carried by the reciprocating carrier and executing instructions to effect printing an initial partial swath on a print medium during a first pass along the scanning path by firing actuators associated with a first plurality of segments of a given column of nozzles, and printing a final partial swath on the print medium during a second pass along the scanning path by firing actuators associated with a second plurality of segments of the given column of nozzles such that each of the segments of the nozzles of the first and second pluralities thereof includes more than one consecutive nozzle so that gaps are created in the partial swath printing that accommodate wind-related effects without causing wind-related print defects on the print medium.

BRIEF DESCRIPTION OF THE DRAWINGS

Figure 1:
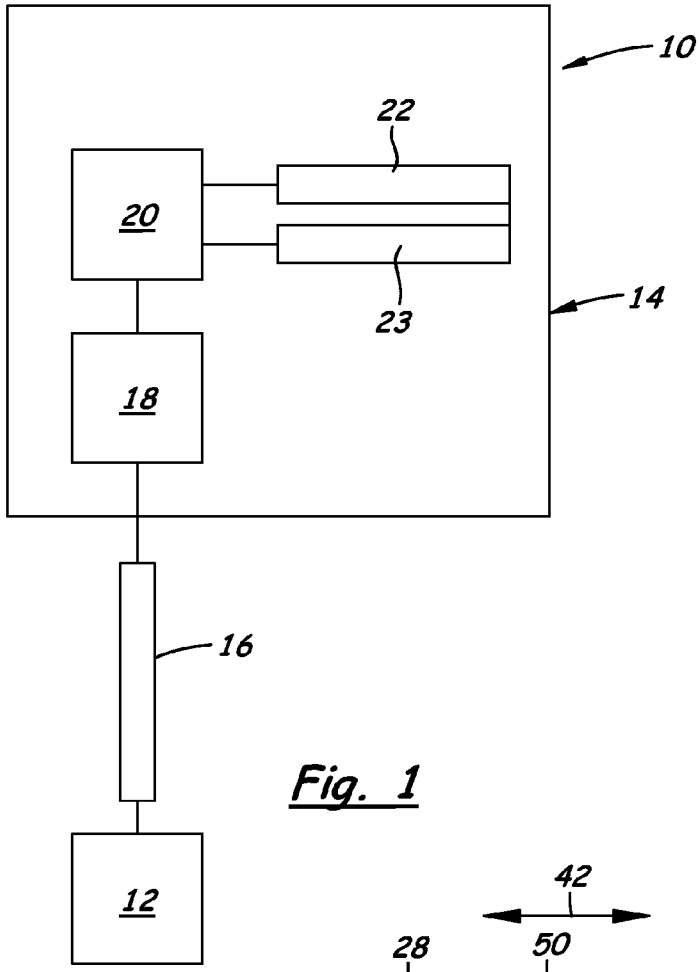

Having thus described the invention in general terms, reference will now be made to the accompanying drawings, which are not necessarily drawn to scale and in some instances portions may be exaggerated in order to emphasize features of the invention, and wherein:

FIG. 1 is a block diagram of an inkjet printing apparatus for performing a two pass print mode method for limiting the amount of wind-related print defects in accordance with the present invention.

Figure 2:
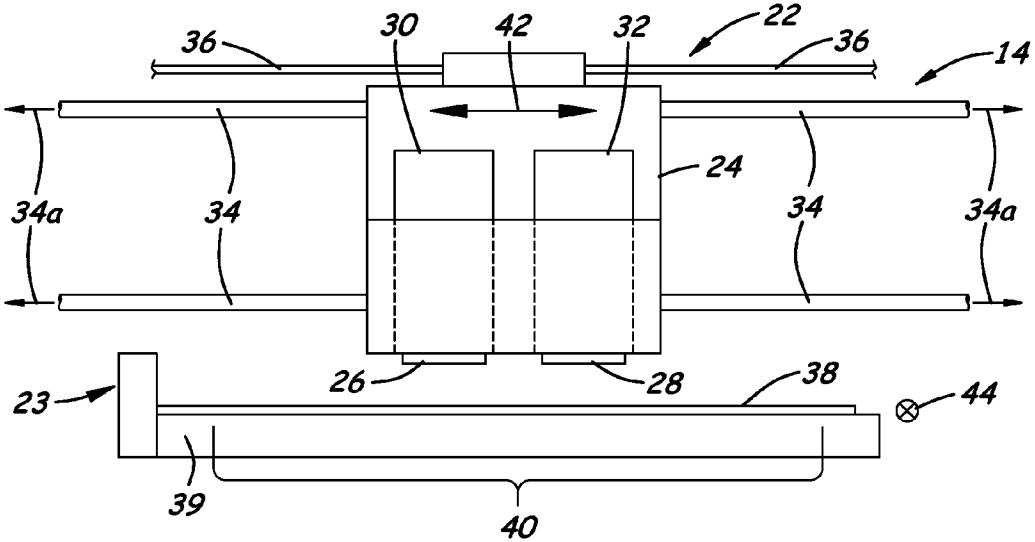

FIG. 2 is a front view of a portion of the printing apparatus of FIG. 1.

Figure 3:
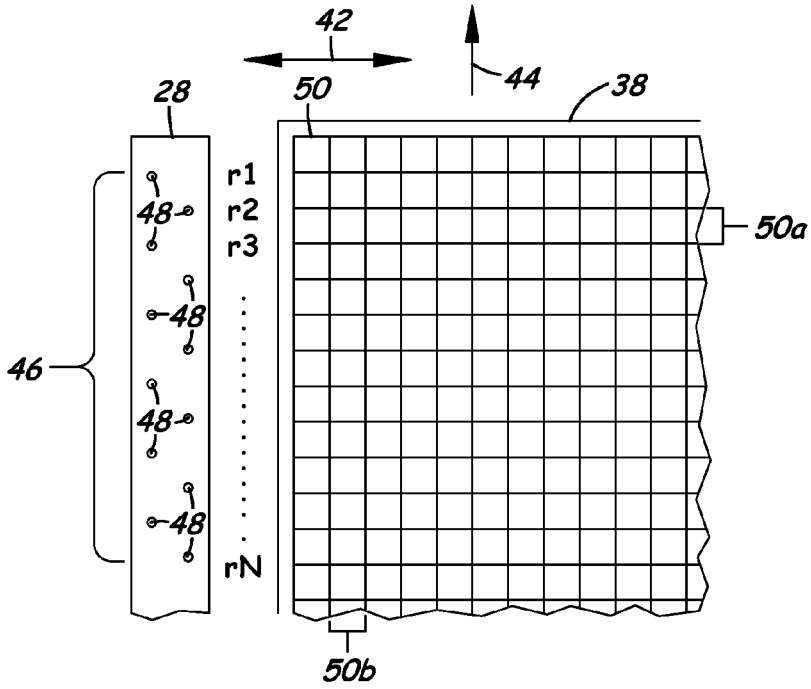

FIG. 3 is a plan view of a printhead nozzle array of the printing apparatus of FIG. 1 and the relationship between individual nozzles of the printhead nozzle array and a rectilinear grid.

Figure 4:
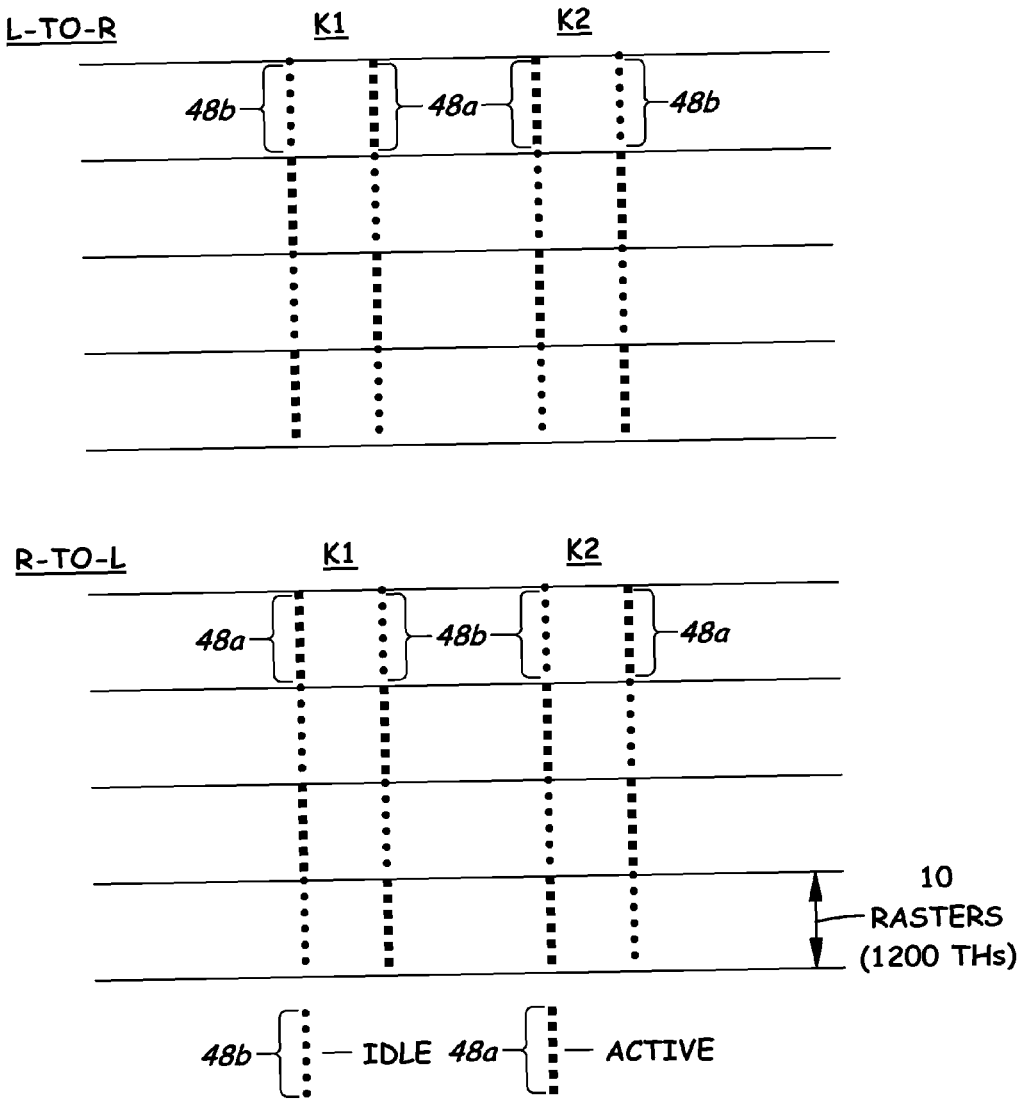

FIG. 4 is a diagram of an exemplary pattern of segments of active and idle nozzles in an array of nozzles of a printhead in accordance with the two pass mode method and apparatus of the present invention.

Figure 5:
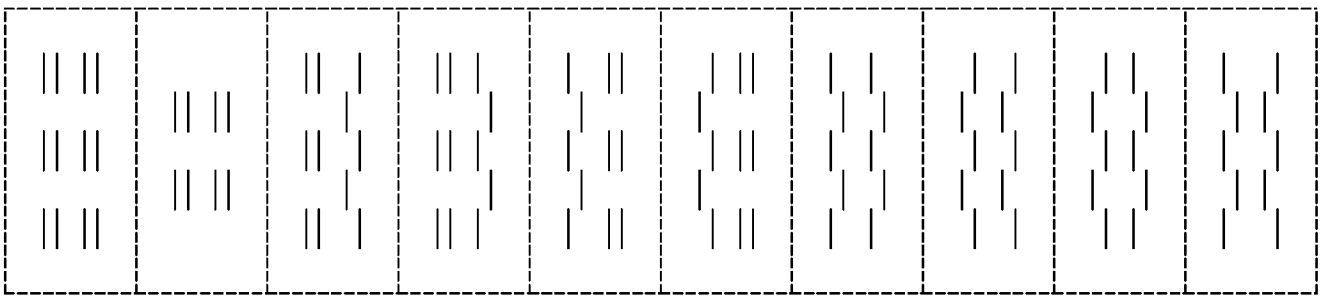

FIG. 5 depicts other diagrams of alternative patterns of segments of active and idle nozzles to that of FIG. 4.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to the drawings and particularly to FIG. 1, there is shown a schematic view of an inkjet printing apparatus, generally designated 10, that is operable for performing a two pass print mode method for limiting the amount of wind-related print defects in accordance with the present invention. The printing apparatus 10 includes a host computer 12 and an inkjet printer 14. The host computer 12 is coupled to the printer 14 via a bi-directional communications link 16. The communications link 16 can be effected, for example, using point-to-point electrical cable connections between serial or parallel ports of the printer 14 and host computer 12, using an infrared transceiver unit at each of the printer 14 and host computer 12, or via a network connection, such as an Ethernet network. The host computer 12 includes application software operated by a user, and provides image data representing an image to be printed, and printing command data, to the printer 14 via the communications link 16. During bi-directional communications, the printer 14 supplies printer information, such as for example printer status and diagnostics information, to the host computer 12 via the communications link 16.

As shown schematically in FIG. 1, the printer 14 includes a data buffer 18, a controller 20, a printhead carriage unit 22 and a print media sheet feed unit 24. The printing command data and image data received by the printer 14 from the host computer 12 are temporarily stored in the data buffer 18. The controller 20, which includes a microprocessor with associated random access memory (RAM) and read only memory (ROM), executes program instructions to retrieve the print command data and image data from the data buffer 18, and processes the printing command data and image data. For the printing command data and image data, the controller 20 executes further instructions to effect the generation of control signals which are supplied to the printhead carriage unit 22 and print media sheet feed unit 23 to effect the printing of an image on a print medium, such as paper. The image data supplied by the host computer 12 to the printer 14 may be in a bit image format, wherein each bit of data corresponds to the placement of an ink droplet at a particular pixel location in a rectilinear grid of possible pixel locations.

Referring to FIG. 2, the printhead carriage unit 22 includes a printhead carrier 24 for carrying a color printhead 26 and a mono or black printhead 28. A color ink reservoir 30 is provided in fluid communication with the color printhead 26, and a mono or black ink reservoir 32 is provided in fluid communication with the mono printhead 28. The printhead carrier 26 is guided by a pair of guide rods 34 which define a bi-directional scanning path **34*a* for the printhead carrier 24. The printhead carrier 24 is connected to a carrier transport belt 36 that is driven by a carrier motor (not shown) to transport the printhead carrier 24 in a reciprocating manner along the guide rods 34. Thus, the reciprocation of the printhead carrier 24 transports the printheads 26, 28 across a print medium 38, such as paper, along bi-directional scanning path 34*a* to define a print zone 40 of the printer 14. This reciprocation occurs in a main scan direction 42 that is parallel with the bi-directional scanning path 34***a*, and is also commonly referred to as the horizontal direction.

During each scan of the printhead carrier 24, the print medium 38 is held stationary by the print media sheet feed unit 23. The print media sheet feed unit 23 includes an index roller 39 that incrementally advances the print medium 38 in a sheet feed direction 44, also commonly referred to as a sub-scan direction or vertical direction, through the print zone 40. As shown in FIG. 2, the sheet feed direction 44 is depicted as an X within a circle to indicate that the sheet feed direction 44 is in a direction substantially perpendicular to the plane of FIG. 2, toward the reader. The sheet feed direction 44 is substantially perpendicular to the main scan direction 42, and, in turn, substantially perpendicular to the bi-directional scanning path 34*a*. The printhead carriage unit 22 and printheads 26, 28 may be configured for unidirectional printing or bi-directional printing.

Referring to FIG. 3, taking the mono printhead 28 for example, it includes an array 46 of ink jetting orifices, commonly referred to as nozzles 48. Each nozzle 48 of the nozzle array 46 has an associated actuator (not shown), such as a heater element or a piezoelectric element, which, when energized at the directive of the controller 20, causes an ink droplet to be expelled from the nozzle 48. Thus, each ink jetting nozzle 48 of the mono printhead nozzle array 46 can be individually and selectively actuated by the controller 20 to expel an ink droplet to form a corresponding ink dot on the print medium 38. The ink jetting nozzles 48 in the nozzle array 46 are disposed in a staggered and horizontally adjacent relationship relative to each other. It will be appreciated that the number of ink jetting nozzles 48 within each array 46 may vary from that shown without departing from the scope of the present invention.

Still referring to FIG. 3, there is also shown the print medium 38 overlaid by an imaginary rectilinear grid 50 of possible pixel locations defined within the printable boundaries of the print medium 38, those locations being where the ink droplets ideally are to be formed. The rectilinear grid 50 includes a plurality of pixel rows (also commonly called rasters r1, r2, r3, . . . rN) 50*a* and pixel columns 50*b* defining the printable image area on the print medium 38. The pixel rows 50*a* are arranged to be horizontally parallel, and parallel with the main scan direction 42. The pixel columns 50*b* are arranged to be vertically parallel, and parallel with the sheet feed direction 46. Each pixel row 50*a* will correspond to a potential printing line on the print medium 38. The center-to-center distance between pixels, sometimes referred to as dot pitch, is determined by the resolution of the printer 14. For example, in a printer capable of printing 1200 dots per inch (dpi), the dot pitch of the array is one twelve-hundredth of an inch. The ink droplets ideally are deposited at the intersections of the lines of the grid 50 defined by the pixel rows and columns 50*a*, 50*b*.

Referring now to FIG. 4, there is a diagram showing the patterns of active (designated by squares) and idle (designated by circles) segments 48*a*, 48*b* of nozzles 48 in column pairs K1, K2 for left-to-right (L-to-R) and right-to-left (R-to-L) print directions. In the example shown, half of the nozzles 48 in each array 46 are active during each pass and printed at full frequency, the other half being idle. Experimentation has shown that a five-on, five-off pattern of segments 48*a*, 48*b* for each array 46 results in enhanced print quality. This pattern of active and idle segments 48*a*, 48*b* of nozzles 48 substantially limits (if not entirely eliminates) the amount of wind-related print defects in the image printed on the print medium 38 during L-to-R and R-to-L printing. For each segment 48*a*, 48*b*, the opposite one of the two sides of nozzle segments 48*a*, 48*b* in column pairs K2 is active versus a given one of the two sides of nozzle segments 48*a*, 48*b* in column pairs K1. For example, in the first row of nozzle segments 48*a*, 48*b* of column pairs K1 and K2 in L-to-R printing the right side of nozzle segments 48*a*, 48*b* of column pairs K1 (high nozzles) and the left side of nozzle segments 48*a*, 48*b* of column pairs K2 (low nozzles) are active. This helps to minimize alignment sensitivity due to via-to-via and x-array offsets and equalizes the dot shape when considering main drop and satellite trajectories. In other words, nozzles 48 are laid out in a pattern so that the sides of pairs of segments 48*a*, 48*b* of the column pairs K2 that are active will always be a mirror image of the sides of the pairs of segments 48*a*, 48*b* of column pairs K1 that are active resulting in decreased sensitivity to alignments and dot shape differences. Additionally, in any given pass substantially 50% of the ink is deposited for any local area. This minimizes bi-directional banding effects, which often result due to dry time differences.

The above-described two pass mode method of the present invention is implemented by printing the two passes without a paperfeed such that the printhead 28 passes over a given swath twice before advancing the paper sheet 38. However, this printing method can also be implemented using traditional bi-directional printing where the printhead 28 advances a distance half of the printhead height each pass or using a small step-big step method to minimize bi-directional dry time banding. The main limitation is sizing the feed step such that the polarity of the pattern switches from pass to pass.

The printer controller 20 executes instructions to carry out the two pass mode method of the present invention. As mentioned, the method uses only half of the nozzles 48 in a given pass (swath), but uses those nozzles 48 during every fire opportunity. The arrangement of the nozzle usage in segments 48*a*, 48*b* of nozzles 48 reduces the wind-related, print defects. The reduced wind-related effect is the result of the segments 48*a*, 48*b* of nozzles 48 being small enough (in number of consecutive nozzles 48 active) to not allow low pressure regions to develop and the voids or breaks being large enough (in consecutive nozzles 48 idle) to allow air flow to pass with less resistance. The number of consecutive nozzles 48 in a given segment 48*a*, 48*b* ranges from a minimum of two to an optimum value determined experimentally (equal to five for the hardware tested) after which the benefit decreases as the number of nozzles increases. The performance improvement can be observed for any nozzle density with the greatest benefit as the dpi increases to 600 dpi and beyond. The preferred number is five nozzles 48 per segment 48*a*, 48*b* for a nozzle density of 1200 dpi. By contrast, a traditional two-pass shingle using a checker pattern in which every other nozzle of a different one half of the nozzles is active during each pass (swath) is subject to wind-related defects which result from increased resistance to air flow such that a low pressure region results on the trailing side of the sheet of jetting nozzles which suspends small ink droplets and eventually releases them onto the sheet resulting in a print quality defect.

Turning now to FIG. 5, there are depicted diagrams of other potential patterns of segments of active and idle nozzles to address the wind-related print defect problem. The most effective, and relatively defect free, pattern of segments is the one described above and illustrated in FIG. 4. The patterns in the diagrams of FIG. 5 are of lesser effectiveness.

To recap, in the employment of the two pass mode method and apparatus of the present invention a strategy is provided for choosing which dots to lay down in a given pass in a way that reduces the aerodynamic effects of a wall of ink being printed at the same time. It breaks, for example, four columns of mono data into segments, and it prints the segments in such a way that there is space left for air to flow around and out. What is involved is a simple change to what nozzles are used or active on a given pass that doesn't slow printing down like using a nozzle subset or slower carrier speed would. Light areas and non-uniform horizontal bands in mono printing are fixed without the negatives of slowing down or using a smaller subset of the nozzles. Also, this simple change fixes adverse effects that occur on printheads made of larger size and having their nozzles brought closer together or packed at greater density. These adverse effects have not been seen on prior printheads of smaller size. In view of the potential for these adverse effects to occur with increase of the printhead size, the present invention will become more advantageous as printhead size increases to fulfill market demands.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A two pass print mode method for limiting wind-related print defects produced during printing by an inkjet printer including a reciprocating carrier that carries a printhead having an array of columns of actuator-fired fluid-jetting nozzles along a bi-directional scanning path, said method comprising:

printing an initial partial swath on a print medium during a first pass along said scanning path by firing actuators associated with a first plurality of segments of a given column of nozzles; and printing a final partial swath on the print medium during a second pass along said scanning path by firing actuators associated with a second plurality of segments of the given column of nozzles such that each of said segments of said nozzles of said first and second pluralities thereof includes more than one consecutive nozzle so that gaps are created in said partial swath printing that accommodate wind-related effects without causing wind-related print defects on the print medium, wherein said nozzles are laid out in a pattern so that sides of pairs of segments of adjacent pairs of the columns of nozzles that are active are mirror images of one another.

2. The method of claim 1 wherein a first half of said nozzles are active and a second half of said nozzles are idle during said first pass.

3. The method of claim 2 wherein said second half of said nozzles are active and said second half of said nozzles are idle during said second pass.

4. The method of claim 1 wherein the number of consecutive nozzles of each segment is greater or equal to two.

5. The method of claim 4 wherein the number of consecutive nozzles of each segment is five.

6. The method of claim 1 wherein the number of consecutive nozzles of each segment is five.

7. The method of claim 1 wherein density of nozzles is greater than or equal to 300 dpi.

8. The method of claim 7 wherein said density of nozzles is 1200 dpi.

9. The method of claim 1 wherein density of nozzles is 1200 dpi.

10. A two pass print mode apparatus for limiting wind-related print defects, comprising:

a printer having a reciprocating carrier that carries a printhead having an array of columns of actuator-fired fluid-jetting nozzles along a bi-directional scanning path; and a controller communicatively coupled to the printhead carried by the reciprocating carrier and executing instructions to effect printing an initial partial swath on a print medium during a first pass along the scanning path by firing actuators associated with a first plurality of segments of a given column of nozzles, and printing a final partial swath on the print medium during a second pass along the scanning path by firing actuators associated with a second plurality of segments of the given column of nozzles such that each of the segments of the nozzles of the first and second pluralities thereof includes more than one consecutive nozzle so that gaps are created in the partial swath printing that accommodate wind-related effects without causing wind-related print defects on the print medium, wherein said nozzles are laid out in a pattern so that sides of pairs of segments of adjacent pairs of the columns of nozzles that are active are mirror images of one another.

11. The apparatus of claim 10 wherein a first half of said nozzles are active and a second half of said nozzles are idle during said first pass.

12. The apparatus of claim 11 wherein said second half of said nozzles are active and said second half of said nozzles are idle during said second pass.

13. The apparatus of claim 10, wherein the number of consecutive nozzles of each segment is greater or equal to two.

14. The apparatus of claim 13 wherein the number of consecutive nozzles of each segment is five.

15. The apparatus of claim 10 wherein the number of consecutive nozzles of each segment is five.

16. The apparatus of claim 10 wherein density of nozzles is greater than or equal to 300 dpi.

17. The apparatus of claim 16 wherein said density of nozzles is 1200 dpi.

18. The apparatus of claim 10 wherein said density of nozzles is 1200 dpi.

* * * * *